US008013228B2

(12) United States Patent
Shimizu

(10) Patent No.: US 8,013,228 B2
(45) Date of Patent: Sep. 6, 2011

(54) ELECTRONIC KEYBOARD MUSICAL INSTRUMENT HAVING KEY ACTUATORS

(75) Inventor: Motohide Shimizu, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 497 days.

(21) Appl. No.: 12/115,664

(22) Filed: May 6, 2008

(65) Prior Publication Data

US 2008/0276789 A1 Nov. 13, 2008

(30) Foreign Application Priority Data

May 7, 2007 (JP) ..... 2007-122396

(51) Int. Cl.
*G10F 1/02* (2006.01)
*G10H 1/32* (2006.01)
*G10C 3/12* (2006.01)

(52) U.S. Cl. ..... 84/423 R; 84/20; 84/744

(58) Field of Classification Search ..... 84/18, 20, 84/25, 433, 723, 725, 726, 744, 423 R
See application file for complete search history.

(56) References Cited

U.S. PATENT DOCUMENTS

2006/0225563 A1 10/2006 Ohba
2008/0163741 A1* 7/2008 Ishihara et al. ..... 84/435

FOREIGN PATENT DOCUMENTS

| | | |
|---|---|---|
| CN | 1838227 A | 9/2006 |
| JP | 11184460 | 7/1999 |
| JP | 2001-184054 | 7/2001 |
| JP | 2005-055541 | 3/2005 |
| JP | 2006-267448 A | 10/2006 |

* cited by examiner

*Primary Examiner* — Jeffrey Donels
*Assistant Examiner* — Andrew R Millikin
(74) *Attorney, Agent, or Firm* — Morrison & Foerster LLP

(57) ABSTRACT

A musical instrument comprises a keyboard assembly including juxtaposed keys and juxtaposed swing weight mechanisms, each of the keys correspondingly linked with each of the swing weight mechanisms. The keyboard assembly is supported on a key bed having an aperture which is elongate in the direction of the key juxtaposition. Actuating members are provided corresponding to the respective swing weight mechanisms each of which in turn actuates each corresponding key. The actuating members are disposed in a lower yoke having a channel member and flanges integrally manufactured by bending a metal plate. The flanges are fastened to the key bed across and over the aperture so that the actuating members penetrate the aperture toward the swing weight mechanism. The height of the channel member determines a relative position between the actuating members and the swing weight mechanism.

2 Claims, 4 Drawing Sheets

Keyboard Arrangment with Actuators

Keyboard Arrangment with Actuators

Actuator Unit

Musical Instrument Body (Side View)

Musical Instrument Body (Bottom View)

Plan View of Solenoid Array

Plan View of Solenoid Array (Prior Art)

ELECTRONIC KEYBOARD MUSICAL INSTRUMENT HAVING KEY ACTUATORS

TECHNICAL FIELD

The present invention relates to an electronic keyboard musical instrument in which musical notes are played back electronically in accordance with the music playing data signals and in addition the keys in the keyboard are physically actuated along with the music playing data signals.

BACKGROUND INFORMATION

Known in the art are player pianos or the like apparatuses. A player piano is an acoustic piano wherein the keys are actuated by a built-in or an externally attached actuator unit including solenoid plungers or the like in accordance with the recorded music playing data such as punched holes on a piano roll and MIDI data on a storage medium, the keys in turn actuating the corresponding piano action hammers to strike the corresponding piano strings, thereby conducting an automatic performance of piano music. An example of such an actuator unit is disclosed in unexamined Japanese patent publication No. H11-184460.

Also known in the art are electronic musical instruments having electronic tone generators wherein the tone generators generate musical tones in accordance with music playing data to conduct an automatic music performance. The music playing data may preferably be of a MIDI format, and may be externally input (e.g. from a sequencer) or may be transferred from an external music work source via a communication network or via a storage medium to a music playing data processing circuit (sometimes further via an internal memory) so that the read-out music playing data control the tone generators to conduct an automatic music performance.

In the case of an electronic musical instrument, an automatic music performance can be conducted without actuating the keys in the keyboard, contrary to the case of an acoustic piano. Recently, however, there is a desire that the keys should move along with the tone generation by the tone generator circuits to visually enjoy the progressing automatic music performance in addition to aural enjoyment of the music. Electronic musical instruments having keys which move along with the progressing automatic music performance conducted by music performance data signals are disclosed, for example, in unexamined Japanese patent publication No. 2001-184054 and in unexamined Japanese patent publication No. 2005-55541.

In the first one of the above referenced publications, the solenoids for actuating the keys are provided near the rear end of the keys at the area away (as viewed from the player) from the swing fulcrum of the keys. In the acoustic piano, the swing fulcrum for the keys resides on the middle rail carrying balance pins according to the regular piano structure, and accordingly a space for placing the solenoid units can be easily prepared in the area away from the middle rail.

In the electronic piano disclosed in the second one of the above referenced publications, a key arm is extended from the key rearward than the swing fulcrum (pivot) of the key, and the rear end of the extended key arm is actuated by the solenoid plunger. This necessitates the space beyond the key and the size of the instrument body will be increased accordingly, and the general merit of an electronic piano as being compact will be impaired.

In the electronic piano disclosed in the third one of the above referenced publications, a swing weight mechanism is provided underneath the key and an actuator (a solenoid plunger) actuates the swing weight mechanism from below. This structure solves the problem of the size increase. However, there is a problem that the actuator and the key bed interfere with each other. In the case of an acoustic piano as in the first one of the above referenced publications, the key bed has a sufficient thickness so that a recess or recesses can be dug therein to accommodate actuators in place of providing through holes or an aperture in the key bed. In the case of an electronic keyboard musical instrument, however, the key bed need not be as thick as an acoustic piano and is usually of a thickness which is insufficient for digging a recess therein, so that an aperture or an opening should be provided in the key bed over an entire width of the keyboard to accommodate the actuators. The key bed is a member which supports the keyboard assembly and bears the player's downward pressing forces of striking the keys to play music, and therefore an aperture or an opening of a length which is almost as long as the entire width of the keyboard may deteriorate the robustness of the key bed, which in turn may deteriorate the robustness of the instrument body.

SUMMARY OF THE INVENTION

In view of the foregoing circumstances, therefore, it is a primary object of the present invention to provide an electronic keyboard musical instrument, such as an electronic piano, in which the keys are actuated by means of actuators based on music playing data and the key bed has an aperture or an opening to accommodate actuators, yet the key bed as well as the instrument body has sufficient robustness.

According to the present invention, the object is accomplished by providing an electronic keyboard musical instrument comprising: a keyboard assembly including a plurality of juxtaposed keys and a plurality of juxtaposed inertia presenting mechanisms, each of the juxtaposed keys being swingably supported on a first swing fulcrum for assuming an undepressed position and a depressed position, and each of the inertia presenting mechanisms being swingably supported on a second swing fulcrum and swingably linked to each corresponding one of the keys; a key bed provided underneath the keyboard assembly for supporting the keyboard assembly, the key bed defining a front edge which is toward an instrument player and a rear edge which is away from the instrument player, the key bed having an aperture provided between the front edge and the rear edge; and an actuator unit having a plurality of actuating members, each of the actuating members being associated with each corresponding one of the inertia presenting mechanisms and arranged at a position which is nearer than the first swing fulcrum to the front edge of the key bed for actuating the corresponding inertia presenting mechanism to bring the associated key from the undepressed position to the depressed position, the actuator unit further having at least an upper and an lower yoke, at least one of the yokes having a channel member and flange members, the channel member disposing the actuating members to penetrate the aperture of the key bed toward the inertia presenting mechanisms, the flange members extending outward from the channel member for fastening the actuator unit to the key bed across and over the aperture.

As the yoke with the channel member and the flange members has an increased second moment of area, and is fastened to the key bed across and over the aperture using the flange members, the actuator unit itself serves to increase the robustness of the key bed, which in turn to increase the robustness of the instrument body as a whole. As the actuator unit is fastened to the key bed by means of the yoke, the number of fastening components is minimized. The aperture in the key bed may be a single opening formed elongate in the direction of the key juxtaposition almost over the entire width of the keyboard, or may be a plurality of separate holes for disposing the individual actuating members, respectively. The actuator unit may be fastened to the key bed by fixing one of the flanges at a position nearer to the front edge of the key bed with respect to the second swing fulcrum for the inertia presenting mechanism and the other of the flanges at a position nearer to the rear edge of the key bed with respect to the second swing fulcrum. The actuator unit may be situated at a middle location between the key bed abutting front and rear ends of the keyboard assembly. The actuating member may preferably actuate the inertia presenting mechanism at a position which is nearer to the second swing fulcrum with respect to the middle point between the fulcrum pivot point and the free end of the inertia presenting mechanism.

The actuating members may be arranged in the vicinity of the second swing fulcrum in two rows as a front row and a rear row with the adjacent actuating members being disposed in the rows different from each other. The stroke of an actuating member in the front row (nearer to the second swing fulcrum) may be smaller than the stroke of an actuating member in the rear row (further from the second swing fulcrum) for the same amount of swing angles of the inertia presenting mechanisms. The actuating members disposed in the front row will then project downward by a smaller amount than the actuating members in the rear row.

In an aspect of the present invention, the channel member has a height with respect to the flanges, wherein the height determines a relative position between the actuating members disposed in the channel member and the inertia presenting mechanisms in the keyboard assembly. The height of the channel member can be arbitrarily obtained through bending process of forming the lower yoke, the relative positions of the plunger actuating members and the swing weight mechanisms can be easily set, even after the structure of the actuating members has been decided.

The present invention will now be described in detail with reference to the drawings showing preferred embodiments thereof. It should, however, be understood that the illustrated embodiments are merely examples for the purpose of understanding the invention, and should not be taken as limiting the scope of the invention.

BRIEF DESCRIPTION OF THE DRAWINGS

For a better understanding of the present invention, and to show how the same may be practiced and will work, reference will now be made, by way of example, to the accompanying drawings, in which.

DETAILED DESCRIPTION OF EMBODIMENTS OF THE INVENTION

The invention and its various embodiments can now be better understood by turning to the following detailed description of the preferred embodiments which are presented as illustrated examples of the invention defined in the claims. It is expressly understood that the invention as defined by the claims may be broader than the illustrated embodiments described below.

Figure 3:
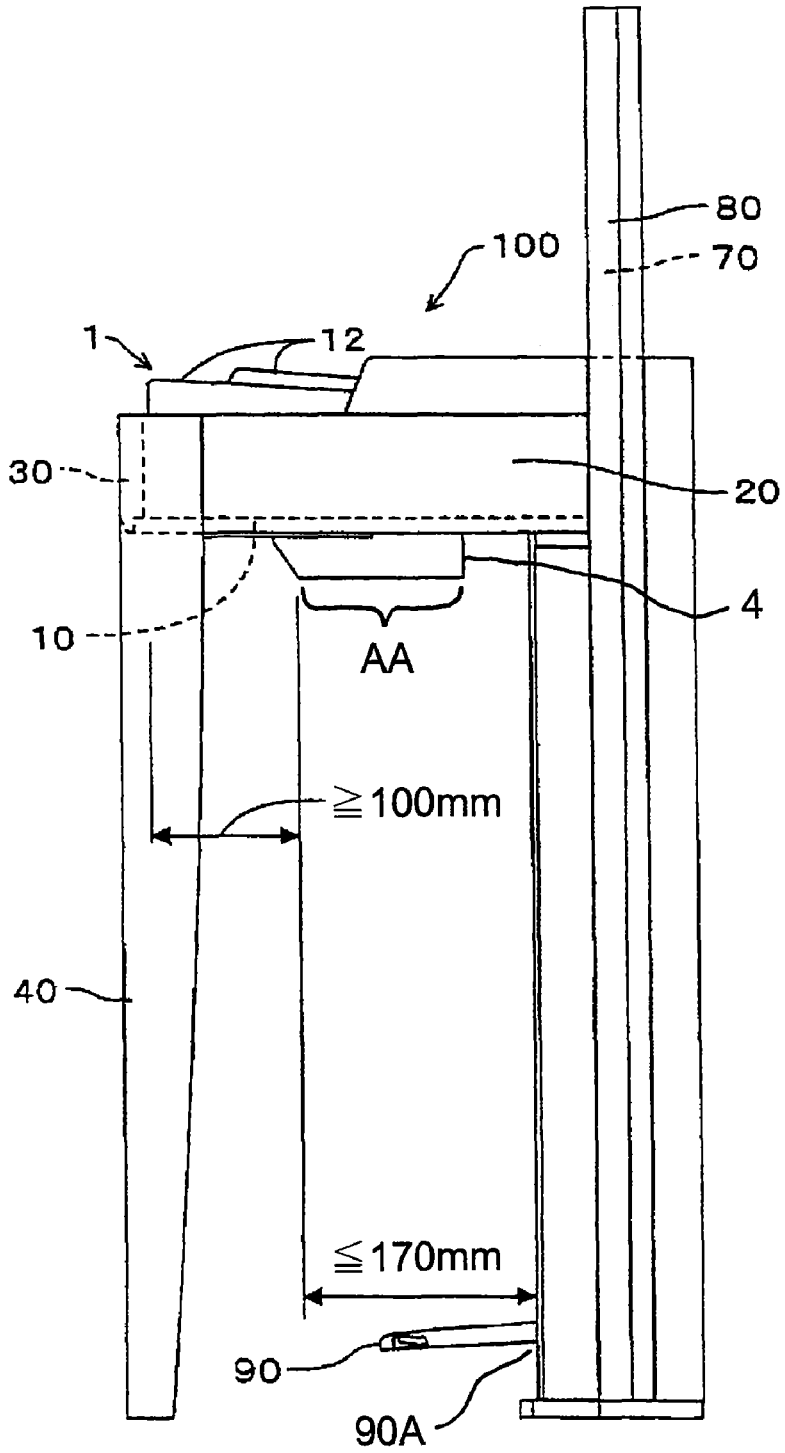
FIG. 3 is a side elevational view of an electronic keyboard musical instrument according to an embodiment of the present invention.
Figure 4:
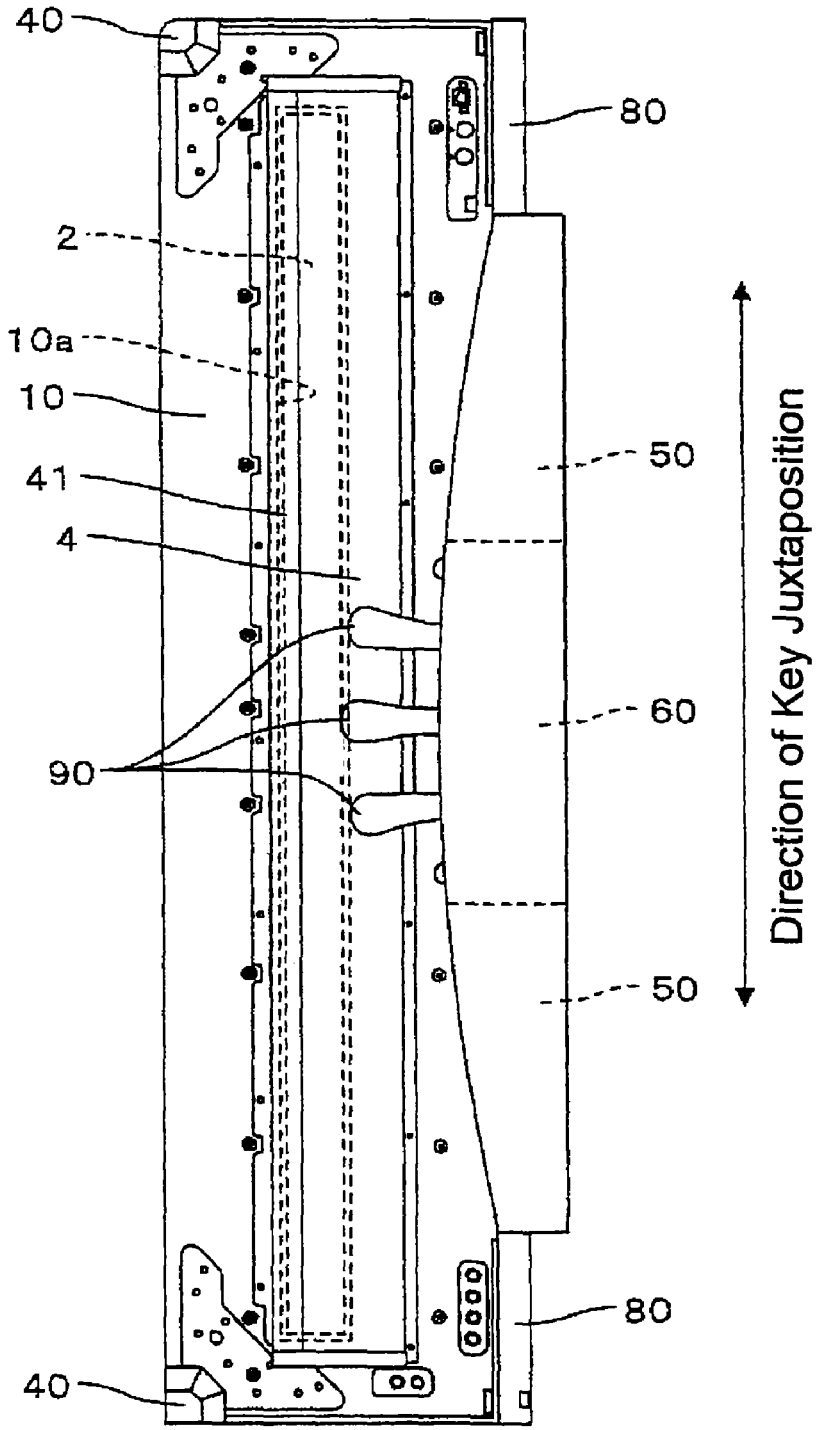
FIG. 4 is a bottom view of an electronic keyboard musical instrument according to an embodiment of the present invention.

Illustrated in FIGS. 3 and 4 is an electronic piano as an example of the electronic keyboard musical instrument embodying the present invention. A main instrument body 100 comprises a key bed 10 of a horizontal flat board on which is supported a keyboard assembly 1, and to which are attached side boards 20 at the right and left ends of the keyboard assembly 1 and a keyslip 30 at the front end of the keyboard assembly 1. At the front end of each of the side boards 20 is fixed a front leg 40 of the instrument to support the instrument body 100.

The rear part of the instrument body 100 includes right and left speaker boxes or enclosures 50, 50 (FIG. 4) which respectively carry right and left loudspeakers therein. A center box 60 is provided between the speaker boxes 50, 50 to carry a pedal mechanism and an electric power circuit, etc. The speaker boxes 50, 50 and the center box 60 constitute a rear leg of the instrument body 100. A central rear panel 70 is provided above the rear leg having approximately the same width as the rear leg at the rear part of the instrument body 100. Right and left side rear panels 80, 80 are also provided on the right and left sides of the speaker boxes 50, 50 and the central rear panel 70, having the same height as the top end of the central rear panel 70. Pedals 90 are projecting from the center box 60 toward the instrument player or user in the lower front area of the center box 60 to be depressed by the player.

Figure 1:
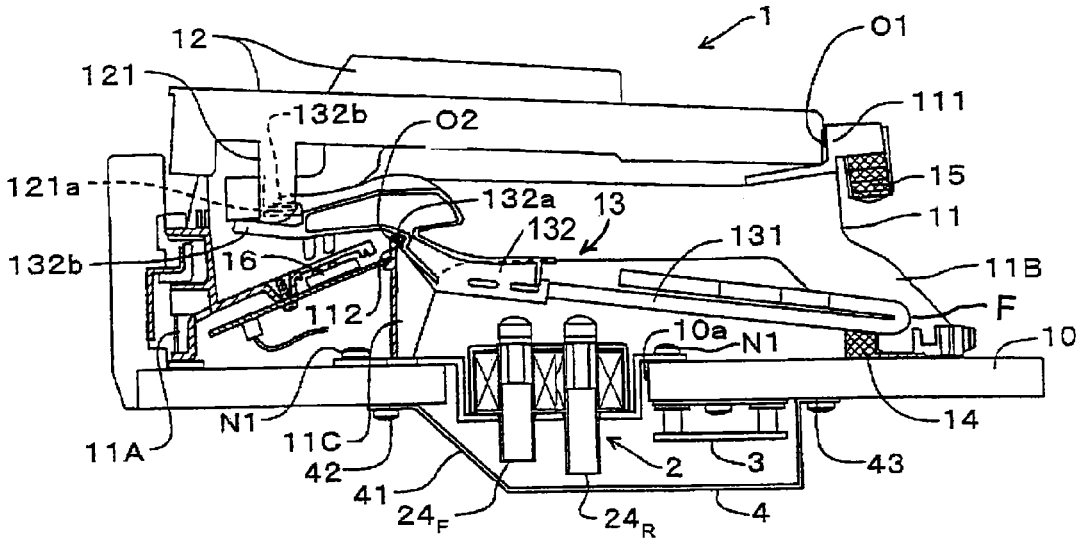
FIG. 1 is a cross-sectional side view of a keyboard arrangement having key actuators around the main portion of an electronic keyboard musical instrument according to an embodiment of the present invention.

The keyboard assembly 1 is mounted on the key bed 10 by means of a keyboard frame 11 as shown in FIG. 1. The keyboard assembly 1 includes a plurality of juxtaposed keys 12 coupled to a supporting rail 111 at the rear end of each of the keys 12. The keyboard frame 11 is fixed to the key bed 10 via front legs 11A, rear legs 11B and middle legs 11C. The keys 12 are arrayed side by side in juxtaposition in the left-to-right direction as seen from the player, and each of the keys is independently supported on the supporting rail 111 to swing up and down about a key swing fulcrum O1 on the rail 111 as the pivoting axis. The key 12 is provided with an actuating projection 121 extending downward from the key body.

Under each of the keys 12 is provided a swing weight mechanism or structure 13 as an inertia presenting mechanism for the movement of each key 12. The swing weight mechanism 13 comprises a bar weight 131 disposed in the front-to-rear direction and a seesaw piece 132 holding the front end of the bar weight 131. The seesaw piece 132 has a downward recess 132*a* which is swingably supported on the top edge of a supporting plate 112 which is formed in the keyboard frame 11 so that the swing weight mechanism 13 can swing up and down about a weight swing fulcrum O2 as the pivoting axis. The front end of the seesaw piece 132 has a connecting fork 132*b* formed with an upper and lower lugs. The actuating projection 121 of the key 12 has a connecting member 121*a* formed at the lower end thereof to engage with the connecting fork 132*b*. As the key 12 is depressed, the actuating projection 121 presses down the seesaw piece 132 of the swing weight mechanism 13 so that the bar weight 131 rotates counterclockwise in the figure about the weight swing fulcrum O2 as the pivoting axis. When the key 12 is released, the bar weight 131 goes down as pulled by gravity to rotate clockwise in the figure to bring the linked key 12 back to the undepressed position. The key frame 11 is provided with stopper pieces 14, 15 made, for example, of felt at an upper inner limit and a lower inner limit of the keyboard frame 11 to limit the swing of the bar weight 131 of the swing weight mechanism 13. In the front area of the keyboard frame 11, there are provided key switches 16 each of which is on/off actuated by the seesaw piece 132 of the swing weight mechanism 13 engaged with each corresponding key 12 in accordance with the depression/release of the key 12.

The key bed 10 is made of fiberboard (MDF, i.e. medium density fiberboard), and is provided with an aperture 10*a* below the joint portion of the bar weight 131 and the seesaw piece 132 of the swing weight mechanism 13. As shown in FIG. 4, the aperture 10*a* is elongate almost over the entire length of the juxtaposed keys 12 of the keyboard assembly 1 in the width direction (right/left direction) of the instrument body 100. In the aperture 10*a* is provided an actuator unit 2 including solenoid units 23 and plungers 24. There is further provided an actuating circuit board 3 on the undersurface of the key bed 10 in the rear of the actuator unit 2 for controlling the actuator unit 2.

Figure 2:
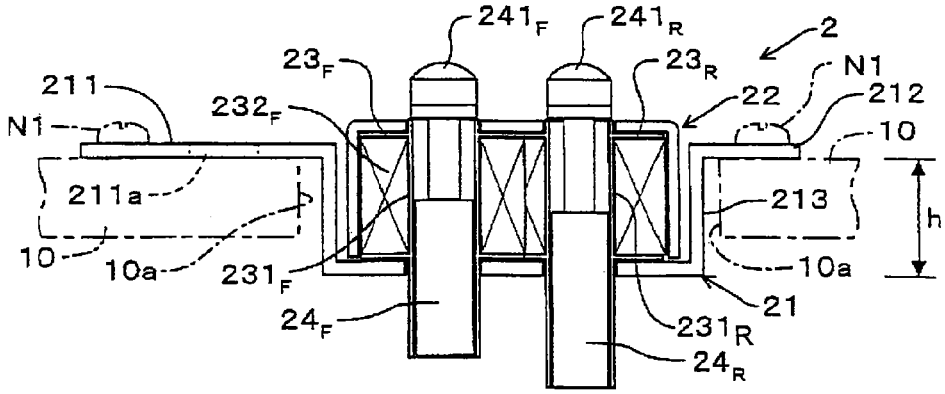
FIG. 2 is an enlarged cross-sectional side view of the part of FIG. 1 that shows the key actuators.

As shown in FIG. 2, the actuator unit 2 comprises a lower yoke 21 of a U-channel shape and an upper yoke 22 of an inverted U-channel shape, both the yokes being elongate in the direction of the key juxtaposition. The upper yoke 22 is fitted in the lower yoke 21 to constitute an outer casing of the actuator unit 2. The lower yoke 21 and the upper yoke 22 are made of a magnetic metal. The lower yoke 21 has a front flange 211 and a rear flange 212 integrally formed with a channel member 213 of U-shaped cross section between the flanges 211 and 212. The actuator unit 2 is fixed to the key bed 10 by abutting the flanges 211, 212 on to the edges of the aperture 10*a* and screwing the flanges 211, 212 on to the key bed 10 using screws N1. The front flange 211 has a through hole 211*a* for accepting the lower end of the middle leg 11C (FIG. 1) of the keyboard frame 11, and a resilient shock absorbing material (not shown) is provided in the through hole 211*a*. The middle leg 11C bears the depressing forces against the keys 12 of the keyboard frame 1 and the resilient material suppresses mechanical noises transmitted from the middle leg 11C to the key bed 10.

The actuator unit 2 comprises solenoid units 23F, 23R and plungers 24F, 24R as actuating members. The suffix F denotes a member in the front row, while the suffix R denotes a member in the rear row. When the members are generally referred to without discriminating between the front and the rear, such suffixes will be omitted. The solenoid unit 23 comprises a bobbin 231 made of a non-magnetic material such as plastic and a coil 232 wound on the bobbin 23 between upper and lower flanges of the bobbin 231, and the plunger 24 is inserted through the bore of the center pipe of the bobbin 231, the center pipe extending outward than both the flanges of the bobbin 231 to guide the plunger in sliding. The solenoid units 23 are held between the lower yoke 21 and the upper yoke 22, with the coils sandwiched between the yokes 21 and 22 and the lower pipe portions extending downward from the lower yoke 21. On the top of the plunger 24 is provided a cushion 241 made of a resilient plastic material.

Under the key bed 10 is attached an actuator cover 4 (FIG. 1) to cover the actuator unit 2 and the actuating circuit board 3 as well as the aperture 10*a*. The actuator cover 4 has a slant wall 41 in its front side, forming a channel having a trapezoid cross section and being elongated in the direction of the key juxtaposition (width direction of the instrument body). The actuator cover 4 has flanges 42, 43 to screw the flanges 42, 43 on to the under surface of the key bed 10 to fix the actuator cover 4 to the key bed 10.

With the above construction, as electric power is supplied from the actuating circuit board 3 to the coil 232 of the solenoid unit 23, an induced magnetic flux passes through the lower yoke 21, the upper yoke 22 and the plunger 24, urging the plunger 24 to thrust upward further from the upper yoke 22. The plunger 24 pushes up via the cushion 241 the seesaw piece 132 or the bar weight 131 of the swing weight mechanism 13 so that the swing weight mechanism 13 rotates counterclockwise as viewed in FIG. 1, which in turn pulls down the key 12 to assume the depressed position of the key 12. More particularly, the front plunger 24F actuates the seesaw piece 132 and the rear plunger 24R actuates the bar weight 131. When the electric power supply to the coil 232 is cut off, the magnetic flux path disappears and the swing weight mechanism 13 rotates clockwise in FIG. 1 as pulled by gravity, which in turn pushes up the key 12 to assume the released or undepressed position of the key 12.

As shown in FIG. 1, the plungers 24F, 24R actuate the swing weight mechanisms 13 at the points which are nearer to the swing fulcrum O2 than the midpoint between the swing fulcrum O2 and the free end F of the bar weights 131. In order to rotate (or swing) the two adjacent swing weight mechanisms 13 by an equal amount of angles, the required stroke of the front plunger 24F may be smaller than the required stroke of the rear plunger 24R. The front plunger 24F and the center pipe of the front bobbin 231F are accordingly smaller in height than the rear plunger 24R and the rear bobbin 231R as shown in FIG. 2. For the same reason, as the plunger 24F, 24R be placed nearer to the swing fulcrum O2 of the swing weight mechanisms 13, the sizes and the strokes of the plungers 24F, 24R can be made smaller.

In other words, where the plungers 24F, 24R and the solenoid units 23F, 23R are disposed near to the swing fulcrum O2 of the swing weight mechanisms 13, the heights of the plungers 24F, 24R and of the bobbins 231F, 231R can be smaller accordingly, which in turn decreases the downward projection of the cover 4 from the key bed 10. This decreases obstructions to the player's knee (and thigh) movements to operate the pedals. Further, as the actuator cover 4 has a truncated portion formed by the slant wall 41 descending rearward and extending underneath the shortened front plungers 24F and front bobbins 231F, a free space for the player's knee movements can be increased.

Figure 5A:
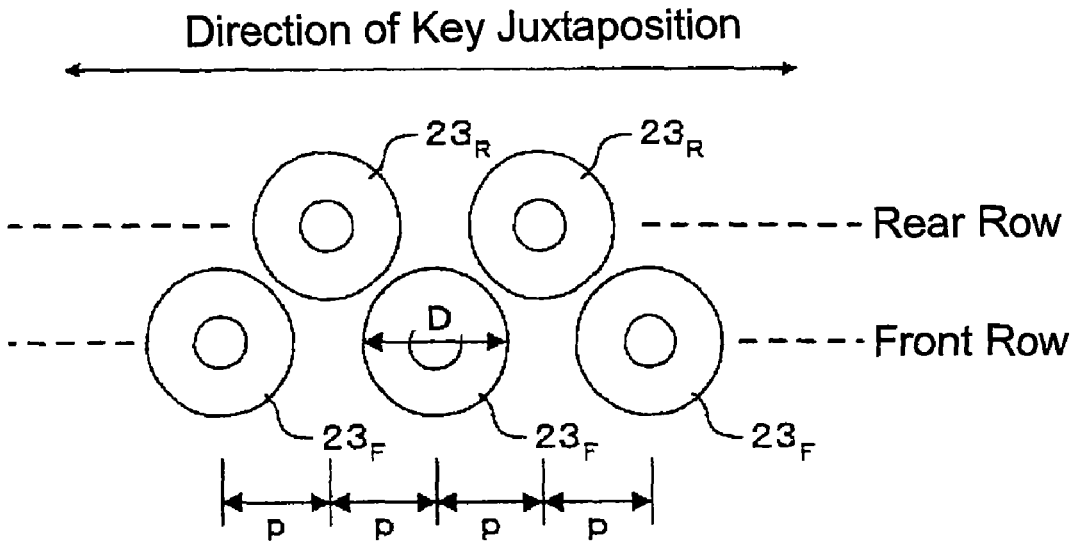
FIG. 5*a* is a plan view showing an array of solenoid plungers functioning as the key actuating members in an electronic musical instrument according to an embodiment of the present invention.
Figure 5B:
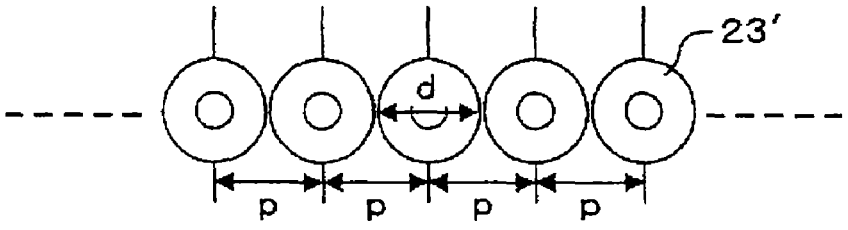
FIG. 5*b* is a plan view showing an example of an array of solenoid plungers functioning as the key actuating members in an electronic musical instrument as employed in a prior art electronic musical instrument.

The solenoid units 23F in the front row and the solenoid units 23R in the rear row are arrayed correspondingly to the respective juxtaposed (adjacent) keys. As the front solenoids 23F and the rear solenoids 23R are alternately arrayed in the front row and the rear row so that every other solenoid 23 belongs to the front row and the remaining every other solenoid 23 belongs to the rear row. This means that the two adjacent solenoids belong to the different rows, and the diameter D of each solenoid 23F or 23R can be designed greater than the pitch p of the key juxtaposition as will be understood from FIG. 5*a*. On the contrary, if the solenoid unit 23' are arranged in a single row as shown in FIG. 5*b*, the diameter d of each solenoid can not be made greater than the key pitch p. As an alternative to the arrangement of FIG. 5*a*, the solenoid units 23 for the white keys may be arrayed in one row, for example in the front row, and the solenoid units 23 for the black keys may be arrayed in the other row, for example in the rear row. This arrangement will be advantageous in visually identifying which solenoid corresponds to which key, still giving the size increasing merit to almost the same degree as the above-mentioned arrangement of FIG. 5*a*.

The nearer to the swing fulcrum O2 of the swing weight mechanism 13 the plungers 24 would be located, the greater power would be necessary to drive the swing weight mechanism 13. As the alternately adjacent solenoids 23F, 23R are located in the different rows, the diameter D of each solenoid 23 can be made larger accordingly as described above, this ensures a larger actuating force by the plunger 24 and allow the plungers 24 to be located nearer to the weight swing fulcrum O2. Consequently, the amount of projection downward from the key bed 10 can be decreased or suppressed.

FIG. 3 illustrates detailed dimensions of the respective parts of the instrument main body 100. The actuator cover 4 for covering the actuator unit 2 is so designed that the lowest part (i.e. the bottom plate) AA of the cover 4 resides or locates within 170 mm in a horizontal dimension from the emerging points or pivoted ends 90A of the pedals 90 (defining the limit of the toe-reach of the instrument player) or more than 100 mm from the front ends of the keys 12 (defining the allowance for the location of the thighs of the instrument player). This ensures unobstructed movements of the player's knees (i.e. legs and feet) for operating the pedals 90 free from the actuator cover 4.

Although the aperture 10*a* in the key bed 10 is provided over almost the entire length of the key juxtaposition in the illustrated embodiment, the rigidity or strength of the key bed 10 is maintained, as the front and rear edge areas of the aperture 10*a* are connected through the flange members 211, 212 and the channel member 213 of the lower yoke 21 of the actuator unit 2. Further, as both the upper yoke 21 and the lower yoke 22 are formed in a U-channel shape, the moment of inertia of the section of the key bed as a whole is accordingly large to ensure the general robustness of the instrument body 100. In addition, as the actuator cover 4 also connects the front and rear edge areas of the aperture 10*a*, the robustness of the instrument body 100 is ensured accordingly.

The distance between (the vertical positions of) the upper end of the plunger 24 (actuating member) of the solenoid unit 23 and the bottom face of the swing weight mechanism 13 depends on the height "h" of the channel member 213 of the lower yoke 21 as seen in FIG. 2. As the height "h" of the channel member 213 can be arbitrarily obtained through bending process of forming the lower yoke 21, the relative positions of the plunger 24 and the swing weight mechanism 13 can be easily set, even after the structure of the solenoid unit 23 has been decided.

Further, as the lower yoke 21 also serves to fix the solenoid units 23 on the key bed 10 as well as to reinforce the key bed 10, no additional components are necessary for fixing the solenoid units 23.

While a single elongate aperture 10*a* is formed in the key bed 10 in the above described embodiment, a plurality of separate holes may be provided for the plurality of corresponding plungers 24, respectively. The actuator unit 2 can be then disposed on the undersurface of the key bed 10 with the lower yoke 21 fixed to the key bed 10 covering the plurality of holes from below.

Still further while the flanges 211 and 212 are formed integral with the lower yoke 21 in the above described embodiment, the flanges may be formed on the upper yoke instead so as to dispose the actuator unit 2 on to the key bed 10 using such flanges.

Alternatively, the key bed 10 may be manufactured by plastic molding, sheet metal bending, aluminum extrusion, or else. Further, the keyboard frame 11 and the key bed 10 may be formed integrally.

The swing weight mechanism may be designed to return to its normal position by means of an urging spring in place of gravity. The swing weight mechanism may be designed reversely so that a bar weight swings with its rear end portion disposed on a fulcrum located near the rear portion of the keyboard assembly, in which the free end of a bar weight is directed toward the front of the keyboard assembly and swings downward when the linked key is depressed. In such a case, however, the actuating unit is to be designed to actuate the swing weight mechanism to swing downward.

While several preferred embodiments have been described and illustrated in detail herein above with reference to the drawings, it should be understood that the illustrated embodiments are just for preferable examples and that the present invention can be practiced with various modifications without departing from the spirit of the present invention.

This application is based on, and claims priority to, Japanese Patent Application N. 2007-122396, filed on May 7, 2007. The disclosure of the priority application, in its entirety, including the drawings, claims, and the specification thereof, is incorporated herein by reference.

What is claimed is:

1. An electronic keyboard musical instrument comprising:

a keyboard assembly including a plurality of juxtaposed keys and a plurality of juxtaposed inertia presenting mechanisms, each of the juxtaposed keys being swingably supported on a first swing fulcrum for assuming an undepressed position and a depressed position, and each of the inertia presenting mechanisms being swingably supported on a second swing fulcrum and swingably linked to each corresponding one of the keys;

a key bed provided underneath the keyboard assembly for supporting the keyboard assembly, the key bed defining a front edge which is toward an instrument player and a rear edge which is away from the instrument player, the key bed having an aperture provided between the front edge and the rear edge; and an actuator unit having a plurality of actuating members, each of the actuating members being associated with each corresponding one of the inertia presenting mechanisms and arranged at a position which is nearer than the first swing fulcrum to the front edge of the key bed for actuating the corresponding inertia presenting mechanism to bring the associated key from the undepressed position to the depressed position, the actuator unit further having at least an upper and an lower yoke, at least one of the yokes having a channel member and flange members, the channel member disposing the actuating members to penetrate the aperture of the key bed toward the inertia presenting mechanisms, the flange members extending outward from the channel member for fastening the actuator unit to the key bed across and over the aperture.

2. An electronic keyboard musical instrument as claimed in claim 1, wherein the channel member has a height with respect to the flanges, the height determining a relative position between the actuating members disposed in the channel member and the inertia presenting mechanisms.

* * * * *